US006588021B2

(12) United States Patent
Kronenberger

(10) Patent No.: US 6,588,021 B2
(45) Date of Patent: Jul. 8, 2003

(54) HEADWEAR PIECE WITH BRIM/VISOR

(76) Inventor: Ronald Kronenberger, 320 Portwine Rd., Riverwoods, IL (US) 60015

( * ) Notice: Subject to any disclaimer, the term of this patent is extended or adjusted under 35 U.S.C. 154(b) by 68 days.

(21) Appl. No.: 09/904,132

(22) Filed: Jul. 12, 2001

(65) Prior Publication Data

US 2003/0009814 A1 Jan. 16, 2003

(51) Int. Cl.[7] ..... A42B 1/00
(52) U.S. Cl. ..... 2/195.1; 2/175.2; 2/195.6
(58) Field of Search ..... 2/195.1, 195.6, 2/195.7, 175.2, 175.1, 175.5, 209.12, DIG. 2

(56) References Cited

U.S. PATENT DOCUMENTS 1,050,310 A * 1/1913 Steinberg et al. ..... 2/172
1,190,427 A * 7/1916 Kromer, Jr. ..... 2/181
1,442,071 A * 1/1923 Jacobs ..... 2/195.6
1,816,346 A * 7/1931 Silverstein ..... 2/172
1,967,012 A * 7/1934 Stack et al. ..... 2/175.1
2,716,753 A * 9/1955 Gordon ..... 2/195.1
2,908,012 A * 10/1959 Feldman ..... 43/57.1
3,128,474 A * 4/1964 Feldman ..... 2/195.6
3,344,437 A * 10/1967 Greene ..... 2/195.6
4,549,316 A * 10/1985 Johnson ..... 2/195.1
5,488,740 A * 2/1996 Garza ..... 2/175.1
5,546,604 A * 8/1996 Geller ..... 2/202
5,845,339 A * 12/1998 Ashley et al. ..... 2/195.6
5,857,219 A * 1/1999 Edmark ..... 2/175.2
6,237,155 B1 * 5/2001 Seegar ..... 2/175.1
6,311,331 B1 * 11/2001 Park ..... 2/195.1
6,408,443 B1 * 6/2002 Park ..... 2/195.1

* cited by examiner

*Primary Examiner*—Rodney M. Lindsey
(74) *Attorney, Agent, or Firm*—Wood, Phillips, Katz, Clark & Mortimer

(57) ABSTRACT

A headwear piece having a crown and a brim/visor projecting away from the crown. The crown has a wall with a surface for engaging a wearer's head to maintain the headwear piece in an operative position on a wearer's head. The brim/visor has an exposed upwardly facing surface, an exposed downwardly facing surface, and an exposed edge between the upwardly and downwardly facing surfaces. The edge has a thickness between the upwardly and downwardly facing surfaces. The edge has a first layer that extends over at least one-fourth of the thickness of the edge, less than the full thickness of the edge, and continuously from the edge to define a part of one of the upwardly and downwardly facing surfaces.

24 Claims, 3 Drawing Sheets

HEADWEAR PIECE WITH BRIM/VISOR

BACKGROUND OF THE INVENTION

1. Field of the Invention

This invention relates to headwear and, more particularly, to a headwear piece having a crown with a brim/visor projecting at least forwardly from the crown.

2. Background Art

One of the most popular pieces of headwear is the baseball-style cap. This cap has a crown portion which embraces the wearer's head and brim/visor projecting in a forward direction therefrom.

The headwear industry is constantly seeking out alternative ways to make the baseball-style cap appealing to the purchasing public, while at the same time facilitating high volume manufacture. A number of these efforts have focused on the brim/visor.

SUMMARY OF THE INVENTION

In one form, the invention is directed to a headwear piece having a crown and a brim/visor projecting away from the crown. The crown has a wall with a surface for engaging a wearer's head to maintain the headwear piece in an operative position on a wearer's head. The brim/visor has an exposed upwardly facing surface, an exposed downwardly facing surface, and an exposed edge between the upwardly and downwardly facing surfaces. The edge has a thickness between the upwardly and downwardly facing surfaces. The edge has a first layer that extends over at least one-fourth of the thickness of the edge, less than the full thickness of the edge, and continuously from the edge to define a part of one of the upwardly and downwardly facing surfaces.

The edge has a length. In one form, the first layer extends over substantially the entire length of the edge.

In one form, the edge has a second layer and the first layer and second layer have a different appearance so as to contrast with each other.

This contrast may be the result of the first and second layers having a different texture, pattern, color, etc.

In one form, the part of the one of the upwardly and downwardly facing surfaces has a width of at least ⅛ inch. This width may be at least ¼ inch, at least ½ inch, or at least ¾ inches.

In one form, the part of the one of the upwardly and downwardly facing surfaces has a substantially uniform width over substantially the entire length of the edge.

The wall surface may extend continuously through 360° around the head of a wearer or may be interrupted so as not to extend continuously around the head of a wearer with the headwear piece in the operative position on a wearer's head.

In one form, the crown has a front and rear and the brim/visor projects from the front of the crown but not from the rear of the crown.

The brim/visor may project from the crown through 360° continuously around the crown.

The crown may have an opening through which a wearer's head is exposed with the headwear piece in an operative position on a wearer's head.

In one form, the edge is defined by only the first layer and second layer over at least a part of the length of the edge.

In one form, the brim/visor has an insert between the upwardly and downwardly facing surfaces to maintain a desired shape of the brim/visor.

In one form, the brim/visor is stitched through the first layer and fully through the brim/visor between the upwardly and downwardly facing surfaces.

In one form the first layer extends over at least one third the thickness of the edge. The first layer may extend through at least half the thickness of the edge.

The invention is also directed to a headwear piece having a crown and brim/visor. The crown has a wall with a surface for engaging a wearer's head to maintain the headwear piece in an operative position on a wearer's head. The brim/visor projects away from the crown. The brim/visor has an exposed upwardly facing surface, an exposed downwardly facing surface, and an exposed edge between the upwardly and downwardly facing surfaces. The edge has a thickness between the upwardly and downwardly facing surfaces. The edge has a first layer that extends over at least ¼ of the thickness of the edge, less than the full thickness of the edge, and continuously from the edge to define a part of the upwardly facing surface.

DETAILED DESCRIPTION OF THE DRAWINGS

Figure 1:
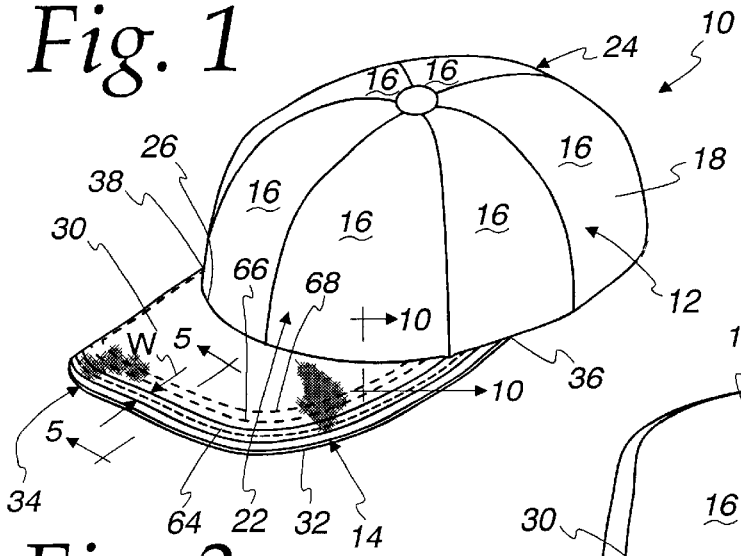
FIG. 1 is a perspective view of a headwear piece with a crown and brim/visor, made according to the present invention.
Figure 2:
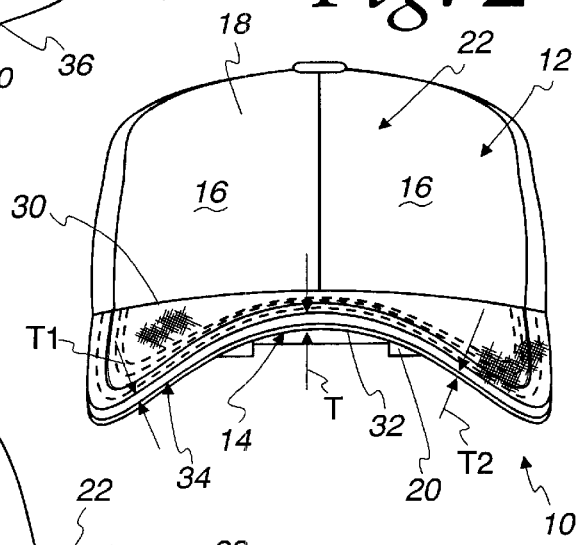
FIG. 2 is a front elevation view of the headwear piece of FIG. 1.
Figure 3:
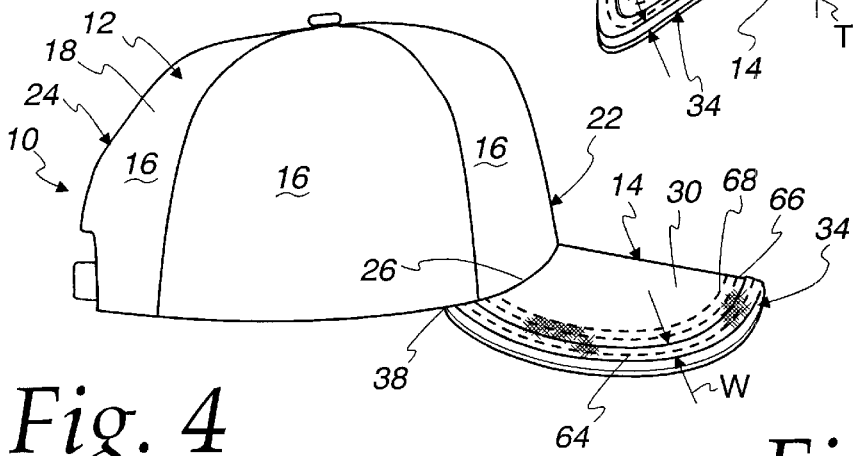
FIG. 3 is a side elevation view of the headwear piece of FIGS. 1 and 2.
Figure 4:
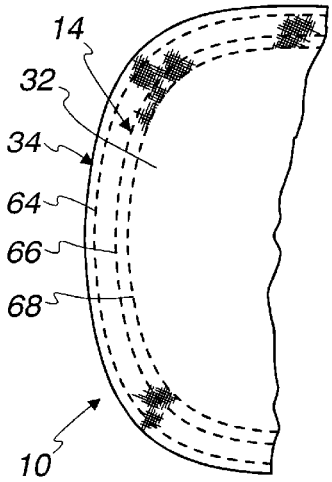
FIG. 4 is a fragmentary, bottom view of the brim/visor on the headwear piece of FIGS. 1–3.
Figure 5:
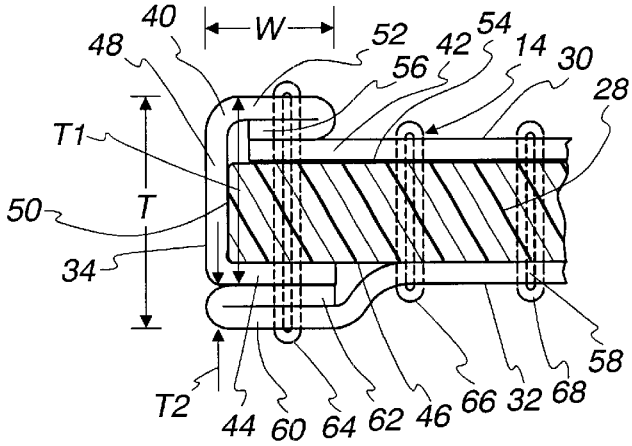
FIG. 5 is an enlarged, fragmentary, cross-sectional view of the brim/visor taken along line 5—5 of FIG. 1.
Figure 6:
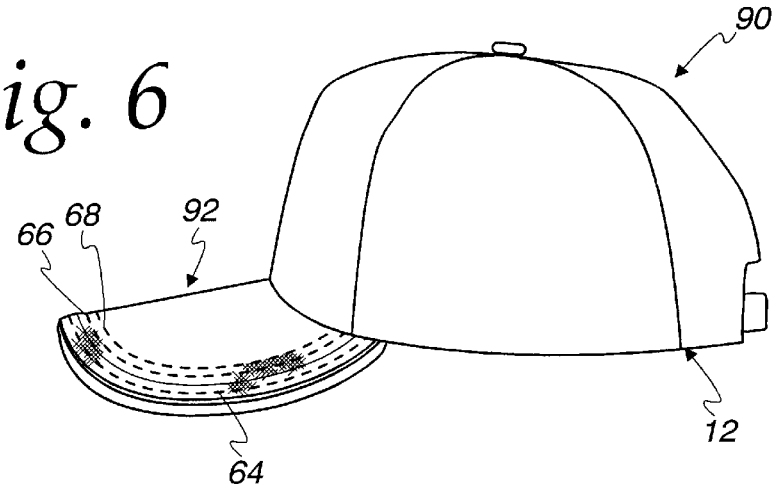
FIG. 6 is a side elevation view of a modified form of headwear piece, according to the present invention.
Figure 7:
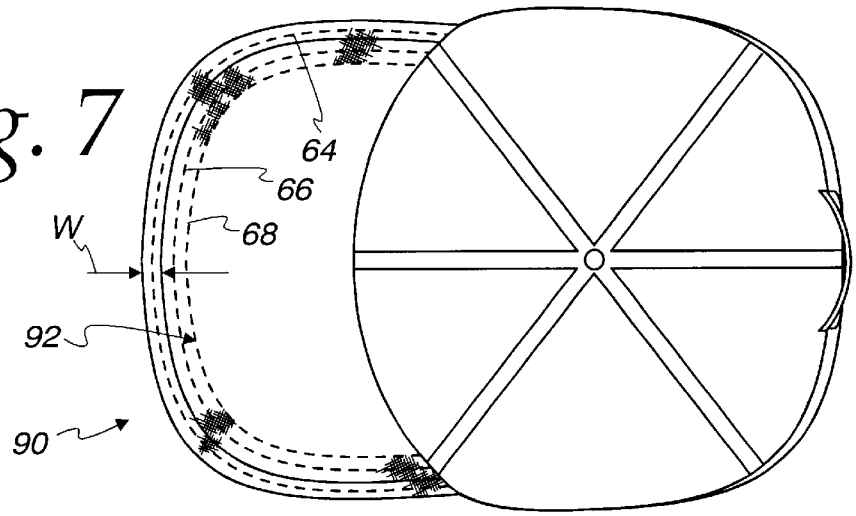
FIG. 7 is a bottom view of the headwear piece of FIG. 6.
Figure 8:
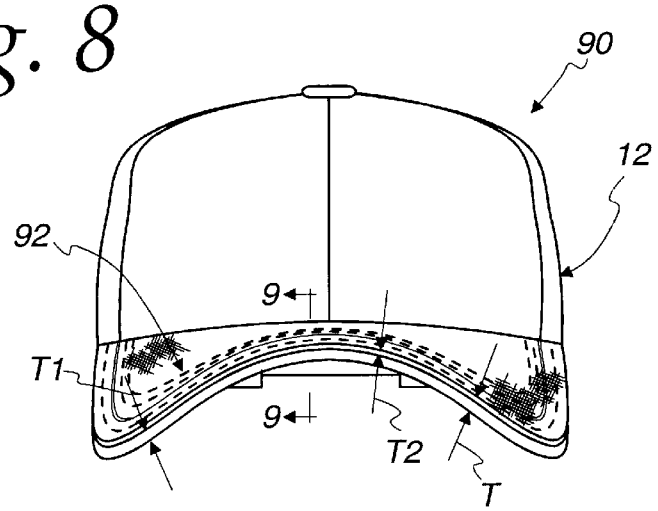
FIG. 8 is a front elevation view of the headwear piece of FIGS. 6 and 7.
Figure 9:
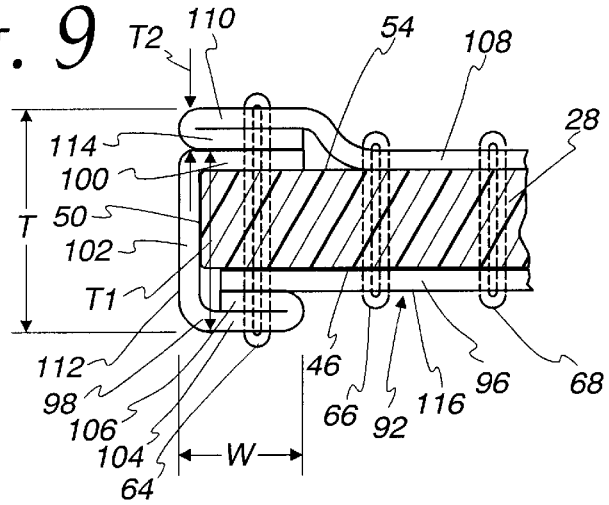
FIG. 9 is an enlarged, fragmentary, cross-sectional view of the brim/visor taken along line 9—9 of FIG. 8.

Referring initially to FIGS. 1–5, one form of headwear piece, made according to the present invention, is shown at 10. The headwear piece 10 is commonly referred to as a baseball-style cap and is shown with an inverted, cup-shaped crown 12 with a brim/visor 14 projecting forwardly therefrom.

The crown 12 is defined by six triangular gores 16 which are sewn edge-to-edge to define a continuous wall 18 with an inside surface 20 that engages a wearer's head with the headwear piece in an operative position thereon. The crown 12 has a front 22 and a rear 24. In this embodiment, the brim/visor 14 projects only from the front of the wall 18.

The brim/visor 14 has a rear edge 26 which conforms to the curvature of the front of the crown 12 and is joined thereto as hereinafter described. The brim/visor 14 has a relatively rigid insert 28 which assists in maintaining the desired shape of the brim/visor 14. The brim/visor 14 has an exposed, upwardly facing surface 30, an exposed downwardly facing surface 32, and an exposed edge 34 between the upwardly and downwardly facing surfaces 30, 32 and a length extending between opposite brim/visor ends 36, 38 between which the brim/visor 14 is joined to the crown 12. The edge 34 extends substantially in a straight line fully between the upwardly and downwardly facing surfaces 30, 32. The edge 34 is substantially orthogonal to the upwardly and downwardly facing surfaces 30, 32 as viewed in section formed by a vertical plane.

The exposed upwardly facing surface 30 is defined partially by each of a first layer 40 and a second layer 42. The first layer 40 has a bottom portion 44 which wraps under the insert 28 and against a downwardly facing surface 46 thereon, a portion 48 which is located at the peripheral edge 50 of the insert 28, and a top portion 52 which extends continuously from the portion 48 to overlie an upwardly facing surface 54 of the insert 28 so as to define a portion of the exposed brim/visor surface 30. The layer 40 extends beyond the portion 52 to define an underlying length 56 which is doubled back and resides between the portion 52 and the second layer 42.

The exposed downwardly facing surface 32 of the brim/visor 14 is defined by a third layer 58 having a portion 60 which projects substantially fully to the edge 34 and is doubled back to define a length 62 which resides between the portion 60 and the portion 44 of the layer 40.

Stitching 64 can be formed in a line generally conforming to the curvature of the edge 34 and extending through the first layer portions 44, 52, the underlying length 56 of the first layer 40, the second layer 42, the third layer portion 60, the length 62 of the layer 58, and the insert 28, fully between the exposed upwardly facing surface 30 and downwardly facing surface 32. Generally conforming lines of stitching 66, 68 are provided at spaced locations through the insert 28 and second and third layers 42, 58.

As viewed from the top of the headwear piece 10, the first layer portion 52 defines a width W on the exposed upwardly facing surface 30. The width W may vary and may be on the order of ⅛ inch, ¼ inch, ½ inch, ¾ inch, or more. The color, texture, and/or pattern on the portion 52 may differ from the color, texture, and/or pattern on the second layer 42 which defines a part of the exposed, upwardly facing surface 30 so that there is a visible contrast between the first and third layers 40, 58 where they meet. However, the width W need not be uniform around the full length of the edge 34.

As viewed from the front and sides, the majority of the thickness T of the brim/visor edge 34 is defined by the portion 48 of the first layer 40, identified as T1. The remainder of the thickness T is defined by two thicknesses of the third layer 58, identified as T2. The relative dimensions of the thickness T1 of the layer portion 48 and the combined thickness T2 of the stacked portions 60, 62 of the third layer 58, may vary considerably. In one exemplary construction, the thickness T1 is less than the total thickness T and at least ¼ of the thickness T. The thickness T1 may be at least ⅓, ½, or more, the thickness T and preferably defines a majority of the thickness T. In a preferred form, the first and second layers 40, 58 alone define the entire thickness T, though this need not be the case.

Figure 10:
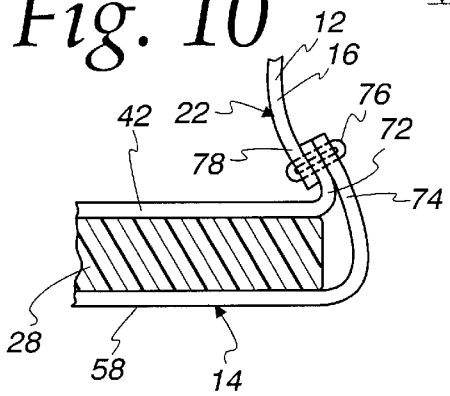
FIG. 10 is an enlarged, fragmentary, cross-sectional view of the connection between the crown and brim/visor taken along line 10—10 of FIG. 1.

A shown in FIG. 10, the ends 72, 74 of the layers 42, 58, respectively, are abutted and joined, by stitching 76, to a depending portion 78 of the crown 12. This unites the crown 12 with the brim/visor 14. With this arrangement, aside from the facilitated manufacture, a unique appearance of the headwear piece 10 results, particularly at the edge 34 and exposed upwardly facing surface 30 of the brim/visor 14.

A modified form of headwear piece, according to the present invention, is shown at 90 in FIGS. 6–9. The headwear piece 90 may have an identical crown 12 and a brim/visor 92 projecting forwardly therefrom. The brim/visor 92 is constructed with the insert 28 and has essentially the identical incorporation of layers as in the headwear piece 10, but with the entire construction inverted relative to the insert 28. That is, a layer 96, corresponding to the second layer 42, is applied at the downwardly facing surface 46 of the insert 28, rather than at the top thereof. A layer 98, corresponding to the first layer 40, has a portion 100 applied to the upwardly facing surface 54 of the insert 28, a portion 102 against the peripheral insert edge 50, and a portion 104 which wraps underneath the layer 96. A length 106 of the layer 98 is doubled back to reside between the portion 104 of the layer 98 and the layer 96. A layer 108 is applied over the upwardly facing surface 54 of the insert 28 and has a portion 110 which projects to a location substantially flush with the edge 112 of the brim/visor 92, as defined by the layer 98, and a doubled back length 114 which resides between the portion 110 of the layer 108 and portion 100 of the layer 98. Lines of stitching 64, 66, 68, as described above, maintain the parts of the brim/visor 14 in assembled relationship.

The thickness T, T1 and T2 shown for the headwear piece 90, and their relative dimensions, correspond to those as described for the headwear piece 10. The same is true for the width W, which identifies the dimension of the layer portion 104 which defines a part of the exposed, downwardly facing surface 116 on the brim/visor 92.

Figure 13:
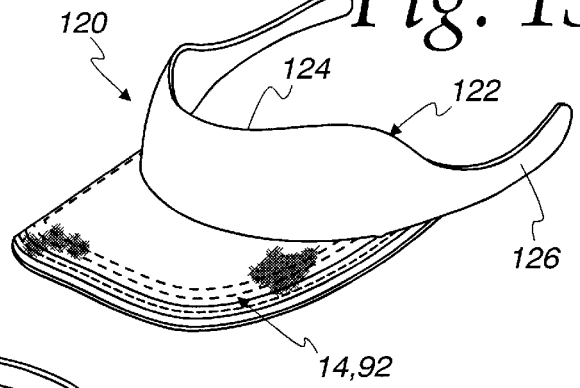
FIG. 13 is a perspective view of still another form of headwear piece, with the present invention incorporated therein.

While the invention is described with respect to a baseball-style cap, it can be practiced with virtually any style of headwear piece in which there is a brim/visor. For example, as shown in FIG. 13, a headwear piece is shown at 120 with a crown 122 having a top opening 124 therein. A crown wall 126 extends only partially around a wearer's head with the headwear piece 120 in an operative position thereon. The brim/visor 14, 92 is constructed as previously described.

Figure 11:
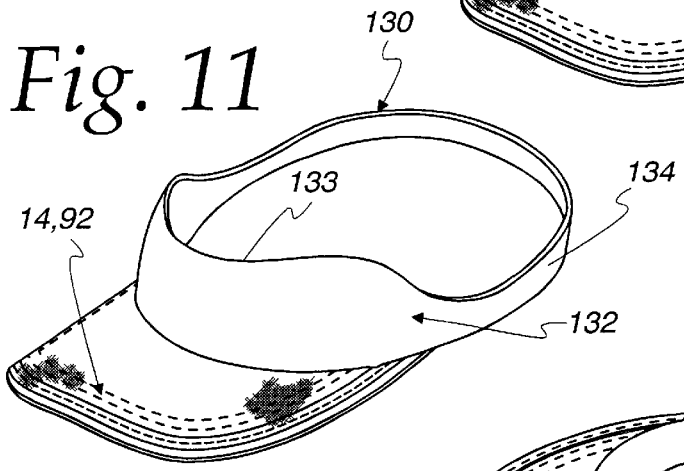
FIG. 11 is a perspective view of a modified form of headwear piece with the present invention incorporated therein.

In FIG. 11, a headwear piece is shown at 130 with a crown 132 having an upper opening 133 in a wall 134 extending continuously around the head of a wearer, with the headwear piece 130 in an operative position. The brim/visor 14, 92 is constructed as previously described.

Figure 12:
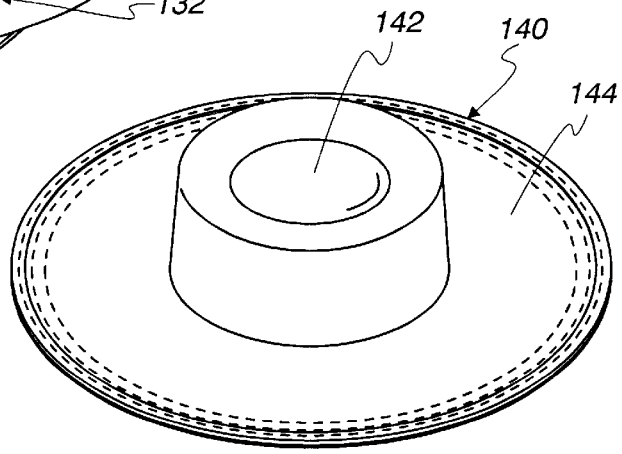
FIG. 12 is a perspective view of another form of headwear piece, with the present invention incorporated therein.

In FIG. 12, a further modified form of headwear piece, according to the present invention, is shown at 140. The headwear piece 140 has a crown 142 with a brim/visor 144 which extends fully around the circumference of the crown 142 and projects outwardly therefrom. The construction of the brim/visor 144 can be the same as that described for the brim/visor 14 or brim/visor 92, described above.

The foregoing disclosure of specific embodiments is intended to be illustrative of the broad concepts comprehended by the invention.

What is claimed is:

1. A headwear piece comprising:

a crown comprising a wall with a surface for engaging a wearer's head to maintain the headwear piece in an operative position on a wearer's head; and a brim/visor projecting away from the crown, the brim/visor having an exposed upwardly facing surface, an exposed downwardly facing surface, and an exposed edge between the upwardly and downwardly facing surfaces, the edge having a thickness between the upwardly and downwardly facing surfaces, the edge comprising (a) a first layer that extends over at least one-fourth of the thickness of the edge, less than the full thickness of the edge, and continuously from the edge to define a part of one of the upwardly and downwardly facing surfaces, and (b) a second layer, the edge defined by the first and second layers extending substantially in a straight line between the upwardly and downwardly facing surfaces.

2. The headwear piece according to claim 1 wherein the edge has a length and the first layer extends over substantially the entire length of the edge.

3. The headwear piece according to claim 1 wherein the first layer and second layer have a different appearance so as to contrast with each other at the edge.

4. The headwear piece according to claim 1 wherein the first layer has a first color, and the second layer has a second color that contrasts with the first color at the edge.

5. The headwear piece according to claim 1 wherein the part of the one of the upwardly and downwardly facing surfaces has a width of at least ⅛ inch.

6. The headwear piece according to claim 1 wherein the part of the one of the upwardly and downwardly facing surfaces has a width of at least ¼ inch.

7. The headwear piece according to claim 1 wherein the part of the one of the upwardly and downwardly facing surfaces has a width of at least ½ inch.

8. The headwear piece according to claim 1 wherein the part of the one of the upwardly and downwardly facing surfaces has a width of at least ¾ inch.

9. The headwear piece according to claim 1 wherein the edge has a length and the part of the one of the upwardly and downwardly facing surfaces has a substantially uniform width over substantially the entire length of the edge.

10. The headwear piece according to claim 1 wherein the wall surface extends continuously through 360° around the head of a wearer with the headwear piece in the operative position on a wearer's head.

11. The headwear piece according to claim 1 wherein the wall surface does not extend continuously around the head of a wearer with the headwear piece in the operative position on a wearer's head.

12. The headwear piece according to claim 1 wherein the crown has a front and rear and the brim/visor projects from the front of the crown but not from the rear of the crown.

13. The headwear piece according to claim 1 wherein the brim/visor projects from the crown through 360° continuously around the crown.

14. The headwear piece according to claim 1 wherein the crown has a top opening through which a wearer's head is exposed with the headwear piece in an operative position on a wearer's head.

15. The headwear piece according to claim 1 wherein the edge has a length and is defined by only the first layer and second layer over at least a part of the length of the edge.

16. The headwear piece according to claim 1 wherein the brim/visor further comprises an insert between the upwardly and downwardly facing surfaces to maintain a desired shape of the brim/visor.

17. The headwear piece according to claim 1 wherein the brim/visor is stitched through the first layer and fully through the brim/visor between the upwardly and downwardly facing surfaces.

18. The headwear piece according to claim 1 wherein the first layer extends over at least one-third the thickness of the edge.

19. The headwear piece according to claim 1 wherein the first layer extends over at least one-half the thickness of the edge.

20. A headwear piece comprising:

a crown comprising a wall with a surface for engaging a wearer's head to maintain the headwear piece in an operative position on a wearer's head; and a brim/visor projecting away from the crown, the brim/visor having an exposed upwardly facing surface, an exposed downwardly facing surface, and an exposed edge between the upwardly and downwardly facing surfaces, the edge comprising (a) a first layer that extends over at least one-fourth the thickness of the edge, less than the full thickness of the edge, and continuously from the edge to define a part of the upwardly facing surface and (b) a second layer, the edge defined by the first and second layers extending substantially in a straight line between the upwardly and downwardly facing surfaces.

21. The headwear piece according to claim 1 wherein the first and second layers extend in a straight line at the edge substantially fully between the upwardly and downwardly facing surfaces.

22. The headwear piece according to claim 21 wherein the line is substantially orthogonal to the upwardly and downwardly facing surfaces as viewed in section formed by a vertical plane.

23. The headwear piece according to claim 20 wherein the first and second layers extend in a straight line at the edge substantially fully between the upwardly and downwardly facing surfaces.

24. The headwear piece according to claim 23 wherein the line is substantially orthogonal to the upwardly and downwardly facing surfaces as viewed in section formed by a vertical plane.

* * * * *